United States Patent [19]

Sombrowski

[11] Patent Number: 4,765,221

[45] Date of Patent: Aug. 23, 1988

[54] ARRANGEMENT FOR RECEIVING WORKING DEVICES ON VEHICLES, ESPECIALLY CHAIN-EQUIPPED VEHICLES

[75] Inventor: Heinz Sombrowski, Danischenhagen, Fed. Rep. of Germany

[73] Assignee: Krupp MaK Maschinenbau GmbH, Kiel, Fed. Rep. of Germany

[21] Appl. No.: 93,401

[22] Filed: Sep. 4, 1987

[30] Foreign Application Priority Data

Sep. 16, 1986 [DE] Fed. Rep. of Germany ..... 8624765

[51] Int. Cl.[4] ..... F41H 11/12

[52] U.S. Cl. ..... 89/1.13; 89/1.11

[58] Field of Search ..... 89/1.11, 1.13

[56] References Cited

U.S. PATENT DOCUMENTS

| | | | |
|---|---|---|---|
| 1,807,150 | 5/1931 | Caldwell | 89/1.13 |
| 1,924,416 | 8/1933 | Rose | 89/1.13 |
| 2,386,025 | 10/1945 | Wills | 89/1.13 |
| 2,419,308 | 4/1947 | Austin | 89/1.13 |
| 2,425,357 | 8/1947 | Walker | 89/1.13 |
| 2,455,636 | 12/1948 | Woolson | 89/1.13 |
| 2,486,372 | 10/1949 | Rockwell | 89/1.13 |
| 2,489,564 | 11/1949 | Dutoit | 89/1.13 |
| 2,496,423 | 2/1950 | Taylor | 89/1.13 |
| 3,771,413 | 11/1973 | Sieg et al. | 89/1.13 |
| 4,552,053 | 11/1985 | Bar-Nety et al. | 89/1.13 |

*Primary Examiner*—David H. Brown

*Attorney, Agent, or Firm*—Erwin S. Teltscher

[57] ABSTRACT

An arrangement for receiving working devices on vehicles, especially a clearing device with rotatable clearing tools for clearing land mines, has a turning arm formed as a traverse and connectable with a vehicle to be offset relative to its longitudinal axis and to turn between a working position transverse to the axis and a transporting position along the axis, two shafts supporting the clearing tools, and a clearing frame connected with the turning arm and supporting the clearing shafts and composed of two frame parts which are turnable relative to one another about an axis extending parallel to the shafts for the transporting position and fixable with one another in the working position.

11 Claims, 2 Drawing Sheets

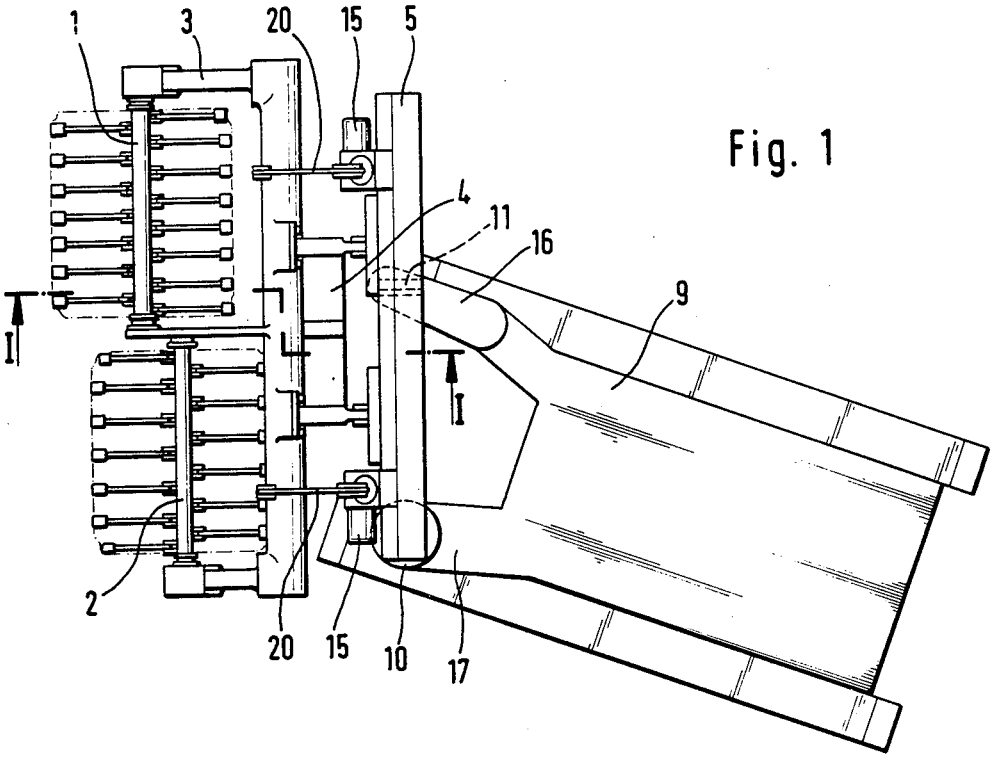
Fig. 1
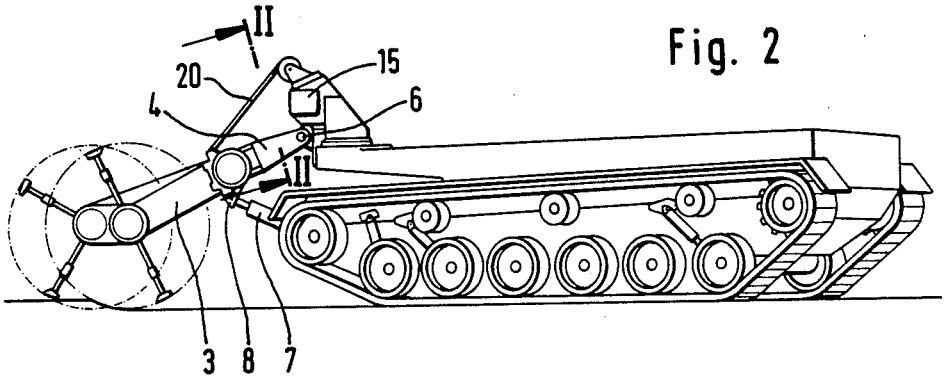
Fig. 2
Fig. 4
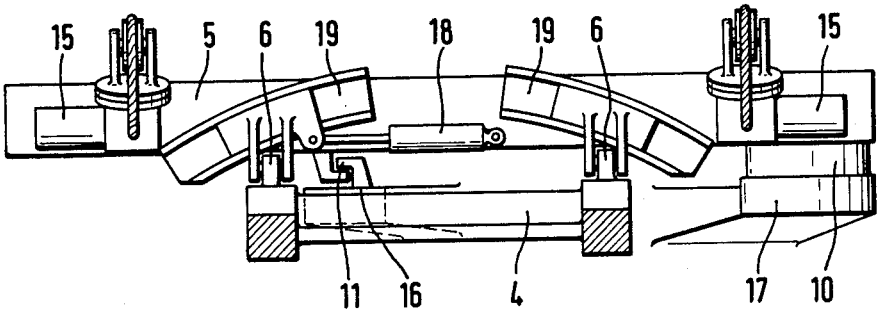

ARRANGEMENT FOR RECEIVING WORKING DEVICES ON VEHICLES, ESPECIALLY CHAIN-EQUIPPED VEHICLES

BACKGROUND OF THE INVENTION

The present invention relates to an arrangement for receiving working devices on vehicles, especially chain- equipped vehicles, for example clearing arrangements for land mines with rotatable clearing tools.

Arrangements of the above- mentioned general type are known in the art. In a known arrangement the clearing tools are supported via clearing shafts in an adjustable clearing frame, and the arrangement is connected with a vehicle by a turning arm which is formed as a traverse. The turning arm is supported with an offset relative to the width of the vehicle. In the working position the turning arm extends substantially transversely to the vehicle axis, while in the transporting position it extends in the direction of the vehicle axis, and it is fixable in the respective end position on the vehicle.

In the arrangements of this type for receiving mine clearing tools, rotary shafts are arranged in front of the vehicle nose. A plurality of hammer-like clearing tools are articulately mounted on the rotary shaft which is formed as a clearing shaft and located off-centrally from the center of rotation. In the known vehicles the horizontally extending clearing shaft is inclined relative to the transverse axis of the vehicle by 15°-25° . During clearing the clearing shaft with the clearing tools is driven in rotation, for example by a hydrostatic drive, and thereby the clearing tools penetrate into the ground because of their high movement energy so as to throw the ground and the land lines which lie in it forwardly.

The clearing frame which supports the clearing shafts is mechanically connected with the vehicle through a supporting arm. The clearing device is mounted on the vehicle so that in the transporting position for street and road transportation it can be placed onto the vehicle deck by its own adjusting device.

In a known system the clearing device is supported inclinedly on a carriage and held through a hydraulic cylinder- piston units which are mounted on the carriage on the one hand and on the clearing device on the other hand. The carriage is guided in rails which are mounted on the vehicle deck parallel to its longitudinal axis an extend through the whole length of the carrier vehicle. For placing the clearing device onto the vehicle deck the hydraulic cylinder-piston unit lifts the clearing device to the required freely accessible height, and after this the carriage and the clearing device are pulled onto the vehicle by a motor-driven unit of the vehicle. The hydraulic cylinder-piston units have during the clearing the task of holding the clearing arrangement at the required height and take up strong vibrations which occur during the clearing process.

An especial characteristic feature of this and other known constructions is that the above described hydraulic cylinder piston units are components of the clearing device and must also be placed onto the vehicle. Therefore they also determine the total height of the vehicle and make impossible in addition to other grounds, the maintenance of a storing size limit for the railroad transportation.

A further disadvantage of this arrangement with the hydraulic cylinder-piston units is that because of the narrow available space they can be articulately mounted only on short lever arms which cause undesirable elasticity of the total system. Still a further disadvantage of this arrangement of the hydraulic cylinder-piston units is that the swinging loads which occur during clearing pass not over shortest path, but through several intermediate members, such as carriage, rail guide, etc. in the carrier vehicle. The play and elasticity connected with this act unfavorably upon the swinging condition of the clearing tool and limit its operational efficiency. Further This narrows the structural possibilities for influencing the own frequency.

SUMMARY OF THE INVENTION

Accordingly, it is an object of the present invention to provide an arrangement of the above mentioned type which provides for a connection with the vehicle in the working position with a higher rigidity and such that during a placing on the vehicle deck the conventional railroad storing size contour is maintained.

In keeping with these objects and with others which will become apparent hereinafter, one feature of the present invention resides, briefly stated, in that the clearing frame is composed of two frame parts which are turnable relative to one another through hinge elements about an axis which is parallel to the clearing shafts and which are arrestable in the working position.

When the arrangement is designed in accordance with the present invention, it is possible to adjust an extremely short force flux from the clearing device in the carrier vehicle and to optimize the springy properties and thereby the own frequency of the system in structural way.

In accordance with another new feature of the present invention, the height adjustment can be performed in a simple manner in that the clearing frame composed of two frame parts is height adjustable in the working position by at least one releasable supporting element, such as a hydraulic cylinder-piston unit, relative to the vehicle. The supporting element is formed as a component of the vehicle and insures an extremely short force flux from the clearing device in the vehicle.

In accordance with another embodiment of the present invention it is proposed that in addition to the supporting element, a cable adjustable through winches engage the frame parts of the clearing frame.

For providing good adaptation to the above described requirements during turning, it is provided in accordance with the invention that the turning arm with the frame part as a supporting arm is turnably adjustable by means of a segment support by adjusting elements for tilting in the clearing plane substantially about the longitudinal axis of the vehicle.

The novel features of the present invention are set forth in particular in the appended claims. The invention itself, however, both as to its construction and its method of operation will be best understood from the following description of a preferred embodiment which is accompanied by the following drawings.

BRIEF DESCRIPTION OF THE DRAWINGS

FIG. 1 is a plan view of a clearing arrangement of the present invention in a working position;

FIG. 2 is a side view of the arrangement of FIG. 1;

FIG. 4 is a view showing a section taken along the line II—II in FIG. 2.

DESCRIPTION OF A PREFERRED EMBODIMENT

Figure 3:
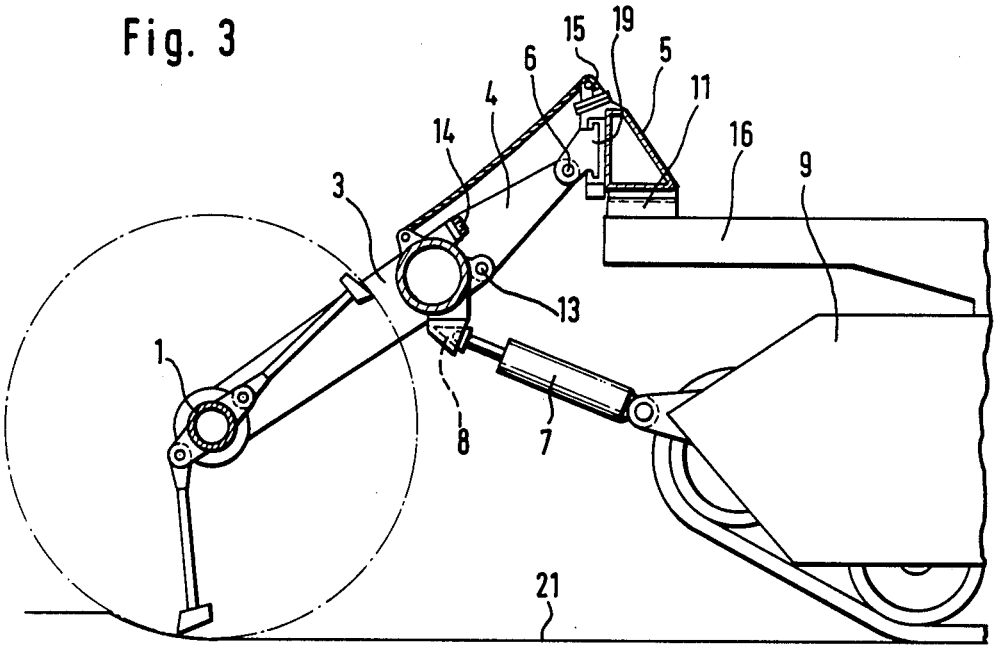
FIG. 3 is a view showing a section taken along the line I—I in FIG. 1.

In the shown arrangement, a carrier vehicle 9 is provided with bracket arms 16 and 17 for receiving a turning arm 5. The turning arm 5 is supported by a bearing 10 rotatably about a vertical axis. The turning arm 5 is blockable by a fixing device 11 on the bracket arm 16, for example hydraulically.

The turning arm 5 has hinge points 6 via which frame parts including a supporting arm 4 and a clearing frame 3 are inclinedly supported. The clearing frame 3 carries clearing shafts 1 and 2 which therefore are also inclinable. The support of the clearing device which includes the elements 1, 2, 3, 4 in the clearing position is performed by an adjusting element 7 which is formed as a hydraulic cylinder- piston unit. The adjusting element 7 is mounted on the carrier vehicle 9 on the one hand and connected via a quickly separable coupling 8 with the supporting mass. Winches 15 are mounted on the turning arm 5 and support the clearing frame 3 with the aid of cables 20 as long as the adjusting element is not coupled. The electrically or hydraulically operated winches 15 can however be controlled also during the clearing process so that they constantly take up a predetermined weight fraction of the clearing arrangement.

The supporting arm 4 is rigidly connected with the clearing frame 3 through blockable hinge elements 13. After loosening a connection 14, for example a screw connection, the supporting arm 4 and the clearing frame 3 are bent about the hinge element 13.

The turning arm 5 is provided with known segment bearings 19 shown in FIG. 4. The supporting arm 4 is inclinedly supported on the segment bearings 19 through the hinge points 6. An adjusting member 18 which is supported on the turning arm 5 on the one hand 5 and on the hinge point 6 on the other hand provides through the segment bearing 19 for a possibility to perform tilting adjustment of the clearing frame 3. The pivot point of the circular tilting movement lies substantially in a clearing plane 21.

Figure 5:
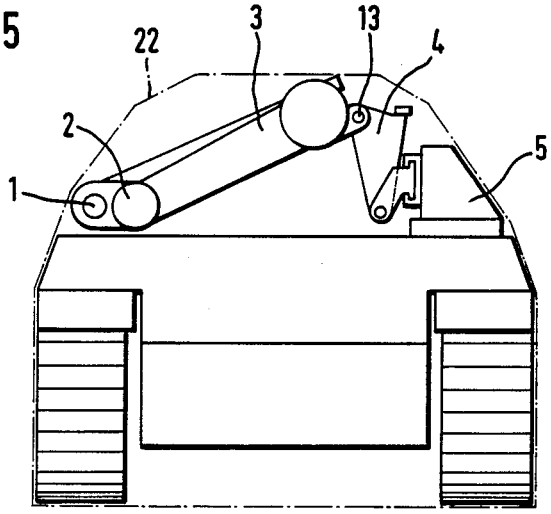
FIG. 5 is a front view with a clearing arrangement in the transporting position.

For adjustment to the storing size contour 22 identified in FIG. 5, the clearing frame 3 and the turning arm 4 are bent through the hinge element of the turning arm 5 substantially in direction of the longitudinal axis of the vehicle to the transporting position.

The invention is not limited to the details shown since various modifications and structural changes are possible without departing in any way from the spirit of the present invention.

What is desired to be protected by Letters Patent is set forth in particular in the appended claims.

I claim:

1. An arrangement for receiving working devices on vehicles, especially chain- equipped vehicles such as a clearing device with rotatable clearing tools for clearing land mines, the arrangement comprising a turning arm arranged to support a clearing device, said turning arm being formed as a traverse and connectable with a vehicle so that said turning arm is offset relative to a longitudinal axis of the vehicle and is turnable between a clearing position in which said turning arm extends substantially transversely to the longitudinal axis of the vehicle and a transporting position in which said turning arm extends substantially in direction of the longitudinal axis of the vehicle;

means for connecting said turning arm with the vehicle turnably between said clearing and transporting positions;

means for fixing said turning arm in said clearing position;

two clearing shafts arranged to support clearing tools;

a clearing frame connected with said turning arm and arranged to support said clearing shafts, said frame having two frame parts which are turnable relative to one another about an axis extending parallel to said shafts for the transporting position and fixable with one another in the clearing position; and means for turnably connecting said frame parts with one another and fixing said frame parts with one another in said clearing position.

2. An arrangement as defined in claim 1, wherein said clearing frame which has two frame parts is adjustable; and further comprising means for adjusting said clearing frame.

3. An arrangement as defined in claim 1; and further comprising hinge means arranged to connect turnably said frame parts with one another.

4. An arrangement as defined in claim 1; and further comprising an additional supporting element arranged to support said frame and including at least one adjustable cable-like supporting member engageable with said frame.

5. An arrangement as defined in claim 1, wherein one of said frame parts is formed as a supporting arm, means for turnably adjusting said turning arm with said supporting arm for tilting in a clearing plane substantially about the longitudinal axis of the vehicle.

6. An arrangement as defined in claim 5; and further comprising adjusting means for adjusting said turning arm with said supporting arm and including a segment bearing arranged to support said supporting arm, and an adjusting element cooperating with said segment bearing.

7. An arrangement as defined in claim 1; and further comprising means for adjusting a height of said frame having said two frame parts, in the clearing position relative to the vehicle.

8. An arrangement as defined in claim 7, wherein said adjusting means for adjusting the height of said frame includes at least one releasable supporting element.

9. An arrangement as defined in claim 8, wherein said releasable supporting element of said adjusting means is formed as hydraulic cylinder- piston unit.

10. An arrangement as defined in claim 8; and further comprising an additional supporting element arranged to support said frame and including at least one adjustable cable-like supporting member engageable with said frame.

11. An arrangement as defined in claim 10; and further comprising a winch arranged to carry said cable-like supporting member of said additional supporting element.

* * * * *